US005842412A

United States Patent [19]

Greenway et al.

[11] Patent Number: 5,842,412

[45] Date of Patent: Dec. 1, 1998

[54] ANTI-MARKING COVERING FOR PRINTING PRESS TRANSFER CYLINDER

[75] Inventors: John Michael Greenway, Westwood; Thomas Higgins, Boston; Robert A. Chiricosta, Lexington; Deborah L. Elsea, Norfolk, all of Mass.

[73] Assignee: BBA Nonwovens Simpsonville, Inc., Simpsonville, S.C.

[21] Appl. No.: 813,557

[22] Filed: Mar. 7, 1997

[51] Int. Cl.[6] ..... B41F 21/00; B41F 22/00

[52] U.S. Cl. ..... 101/420; 101/416.1; 492/48

[58] Field of Search ..... 101/407.1, 409, 101/413, 415, 416.1, 417, 419, 420, 422; 492/29, 55, 59, 48

[56] References Cited

U.S. PATENT DOCUMENTS

| | | | |
|---|---|---|---|
| 401,790 | 4/1889 | Osborne | 101/138 |
| 944,607 | 12/1909 | Goldsmith | 118/261 |
| 1,152,596 | 9/1915 | Boucher | 492/48 |
| 1,231,141 | 6/1917 | Ellis | 101/422 |
| 1,231,142 | 6/1917 | Ellis | 101/407.1 |
| 1,255,603 | 2/1918 | Hartmann | 101/415.1 |
| 1,414,104 | 4/1922 | Strawn | 101/415.1 |
| 1,711,596 | 5/1929 | Grammer | 101/422 |
| 1,789,244 | 1/1931 | McCollum | 101/348 |
| 1,933,161 | 10/1933 | Claybourn et al. | 101/422 |
| 2,011,181 | 8/1935 | Melton et al. | 101/420 |
| 2,068,456 | 1/1937 | Hooper | 428/128 |
| 2,085,845 | 7/1937 | Binkley | 101/420 |
| 2,149,606 | 3/1939 | Jones | 492/29 |
| 2,329,152 | 9/1943 | Breyer | 101/422 |
| 2,555,319 | 6/1951 | Cross | 101/420 |
| 2,804,417 | 8/1957 | Cross et al. | 101/420 |
| 2,878,742 | 3/1959 | Trump | 34/663 |
| 3,180,115 | 4/1965 | Marshall | 66/170 |
| 3,261,288 | 7/1966 | Dickerson | 101/420 |
| 3,308,522 | 3/1967 | Miller | 101/420 |
| 3,597,818 | 8/1971 | Beck | 492/33 |
| 3,730,794 | 5/1973 | Ross | 156/112 |
| 3,750,571 | 8/1973 | Germann | 101/415.1 |
| 3,791,644 | 2/1974 | DeMoore | 271/314 |
| 3,892,179 | 7/1975 | Jahn | 101/415.1 |
| 3,910,186 | 10/1975 | D'Amato et al. | 101/156 |
| 3,926,701 | 12/1975 | Nishiwaki | 156/86 |
| 4,023,967 | 5/1977 | McGibbon | 430/117 |
| 4,214,526 | 7/1980 | Jeschke | 101/183 |
| 4,227,459 | 10/1980 | Jeschke | 101/415.1 |
| 4,339,858 | 7/1982 | Peterson | 492/48 |
| 4,400,418 | 8/1983 | Takeda et al. | 428/36.1 |
| 4,402,267 | 9/1983 | DeMoore | 101/419 |

(List continued on next page.)

FOREIGN PATENT DOCUMENTS

| | | |
|---|---|---|
| 36937 A1 | 10/1981 | European Pat. Off. . |
| 59944 A1 | 9/1982 | European Pat. Off. . |

*Primary Examiner*—Stephen R. Funk
*Attorney, Agent, or Firm*—Ostrager Chong Flaherty & Onofrio

[57] ABSTRACT

An anti-marking covering for use on a printing press transfer cylinder to prevent ink marking of printed sheets is made of a material having a high axial air permeability through the material parallel to its surface and a substantially uniform surface structure free of raised areas. A preferred material is 100% rayon hydroentangled nonwoven fabric subjected to comb-roll microcreped compressive forming of microcreped areas closely spaced about 1/16 inch apart. The preferred fabric has an axial air permeability of about 0.279 cfm. When the material is wrapped tightly onto a press cylinder, the high axial air permeability allows an air layer to be maintained under the printed sheets, and the uniform surface structure is free of high points that might protrude through the air layer and contact the printed sheets. Other fabrics and materials suitable for the anti-marking covering include woven and knitted fabrics, nonwoven fabrics, and open-celled foam. The preferred materials have an axial air permeability not less than about 0.138 cfm, and a surface structure with closely spaced features of a spacing not more than about 0.125 inch.

17 Claims, 6 Drawing Sheets

U.S. PATENT DOCUMENTS

| | | | |
|---|---|---|---|
| 4,552,069 | 11/1985 | Jahn | 101/420 |
| 4,688,784 | 8/1987 | Wirz | 271/195 |
| 4,691,632 | 9/1987 | DeMoore | 101/426 |
| 4,761,324 | 8/1988 | Rautenberg et al. | 428/198 |
| 4,868,958 | 9/1989 | Suzuki et al. | 28/104 |
| 4,921,752 | 5/1990 | Eschenbach | 422/247 |
| 4,967,661 | 11/1990 | Duarte | 101/420 |
| 4,973,040 | 11/1990 | Kemp et al. | 271/277 |
| 5,007,342 | 4/1991 | Abendroth et al. | 101/420 |
| 5,009,160 | 4/1991 | Duarte | 101/422 |
| 5,042,384 | 8/1991 | DeMoore et al. | 101/483 |
| 5,046,421 | 9/1991 | DeMoore | 101/420 |
| 5,115,740 | 5/1992 | Emrich et al. | 101/420 |
| 5,219,160 | 6/1993 | Kemp | 271/275 |
| 5,243,909 | 9/1993 | DeMoore et al. | 101/420 |
| 5,245,923 | 9/1993 | Vrotacoe | 101/217 |
| 5,253,027 | 10/1993 | Goto | 355/290 |
| 5,320,042 | 6/1994 | Schwopfinger | 101/416.1 |
| 5,405,643 | 4/1995 | Scholz | 602/8 |
| 5,415,098 | 5/1995 | Ward | 101/493 |
| 5,511,480 | 4/1996 | DeMoore et al. | 101/492 |
| 5,540,982 | 7/1996 | Scholz et al. | 602/8 |
| 5,579,691 | 12/1996 | Voge | 101/420 |

ANTI-MARKING COVERING FOR PRINTING PRESS TRANSFER CYLINDER

SPECIFICATION

TECHNICAL FIELD

This invention relates to a method and material for preventing ink marking of sheets conveyed on a printing press, and particularly to an improved anti-marking covering for a printing press transfer cylinder.

BACKGROUND OF INVENTION

Various methods have been used to effect the transfer of printed sheets from one printing station to another, or from a printing station to a press delivery, without ink marking or smearing the freshly printed (wet) ink on the sheets. The marking and smearing of freshly printed sheets has been an historic and troublesome problem for printing. Printing press manufacturers have attempted to deal with this problem using various types of skeleton (sprocket) wheels, cylinders, and other mechanical devices. While effective under certain ideal conditions, none of them have truly solved the problem over a range of printing conditions.

U.S. Pat. No. 4,402,267, which was issued to DeMoore and assigned to Printing Research Corp., Dallas, Tex., discloses a method of modifying a printing press transfer cylinder by coating the circumferential surface of the cylinder with a low-friction fluorocarbon plastic and installing an ink-repellent fabric, such as a treated gauze material, loosely around the outer surface of the cylinder. The loose wrapping of the fabric and the low friction of the cylinder coating are intended to permit the fabric covering to have a shuffling movement and a cushioning effect upon contact with a freshly printed sheet in order to prevent the smearing of ink.

The DeMoore patent describes the use of plain weave fabrics to obtain the shuffling and cushioning effects. However, several deficiencies to the purposes stated in the DeMoore patent can be expected when loosely-applied plain weave fabrics are used on a transfer roll. Plain weave fabrics have virtually no elasticity and hence have a tendency to bag when applied loosely. It can be appreciated that, due to the low elasticity of the woven material, the maximum shuffling effect will occur at the center of the fabric. The edges of the fabric which are attached to the transfer roll will exhibit only slight movement. The woven fabric will also tend to lie flat and exhibit only a limited cushioning effect.

In commercial use, Printing Research Corp. has sold a different covering material for the transfer roll called SUPER BLUE™ fabric, which is a pleated gauze fabric not disclosed in the previously described patent. The SUPER BLUE™ covering material is treated with ink-repellent chemical and purportedly allows the wet side of a printed sheet to cling to the material upon contact and to move together freely over the low-friction cylinder surface. As a gripper bar removes the sheet from the cylinder, the ink-repellent material readily releases from the sheet. However, the present inventors have found that use of the pleated gauze fabric has the deficiency that the widely-spaced raised areas of the pleats will contact the freshly printed sheet and, despite the ink-repellent treatment, will act as high points where ink can collect. The ink may then be transferred from the high points back onto the next sheets.

An alternative system is proposed in U.S. Pat. No. 5,415,098 issued to Ward wherein the outer surface of the transfer cylinder has a matte finish and has a ridged netting or krinkle gauze fabric wrapped tightly thereon, but not so tightly as to pull out all the ridges. The wrapping in fact must be applied fairly loosely with some skill in order not to pull out the ridges, which is deemed to be similar in many respects to the installation procedure for the aforementioned SUPER BLUE™ fabric. The purpose of the matte finish on the transfer roll is to prevent movement of the fabric relative to the cylinder. The ridges of the fabric are designed to engage the printed sheet to promote transfer of the sheet and also to provide a cushioning effect when the printed sheets make contact with the material. As with the SUPER BLUE™ fabric, the ridges in the Ward material act as high points where ink can collect and be transferred back onto the next printed sheets.

Furthermore, the above-described prior art covering materials have a tendency to bag during extended use and may require periodic readjustment on the transfer roll. The gauze material can have gathers and pills which can act as high points where ink can collect and be transferred back onto the next sheets. While use of the pleated or ridged fabrics provides some anti-marking benefits when compared to skeleton wheels and other mechanical devices, such fabrics are intended to function by making contact with the printed sheets and will inevitably transfer some ink to the next sheets.

SUMMARY OF THE INVENTION

It is therefore a principal object of the present invention to overcome the problems of printing press anti-marking systems in the prior art, and particularly to solve the problem of ink transfer due to contact of freshly printed sheets with the surface covering of a transfer cylinder. The present invention proceeds from the recognition that contact of the printed sheets with the cylinder is undesirable, and therefore seeks to minimize and avoid such contact as much as possible.

The inventors have found that contact of freshly printed sheets with the covering of a transfer cylinder can be substantially eliminated by using a covering that has a substantially uniform surface structure free of raised areas that can act as high points contacting the printed sheets, and which has a high level of air permeability through the covering (parallel to the covering surface) so as to allow an air layer to be maintained between the printed sheet and the covering. The more uniform is the surface of the covering, the lower the air permeability and the smaller the air layer that needs to exist for contact not to occur.

In a preferred embodiment, the anti-marking covering is a fabric secured onto the outer surface of a press cylinder. The fabric has a three-dimensional surface structure that obtains a high level of ("axial") air permeability through the fabric parallel to the fabric surface sufficient to maintain a layer of air between it and sheets conveyed over the cylinder. A preferred material is 100% rayon hydroentangled nonwoven fabric subjected to comb-roll MICREX™ compressive forming of microcreped areas closely spaced about 1/16 inch apart. The microcreped nonwoven fabric has an axial air permeability of about 0.279 cfm which allows air to flow and an air layer to be maintained under the sheets. The surface structure of the fabric is substantially uniform (from the standpoint of sheet transport) free of high points that might protrude through the air layer and contact the printed sheets.

The invention can also employ other types of fabrics and materials suitable for the anti-marking covering, such as woven or knitted fabrics, open-celled foam, other types of nonwoven fabrics, etc. The preferred materials can have an axial air permeability as low as 0.138 cfm, and their surface structure should be substantially flat or composed of closely spaced features with spacings from 0.125 to 0.062 inch or less.

In another embodiment, the press cylinder has a porous surface, such as one perforated with holes, and an anti-marking covering over the surface of the cylinder having an open structure which is substantially uniform and free of raised areas. The open structure functions to distribute air supplied from the cylinder holes through the covering material. This permits a wide range of open-structured fabrics and other materials having lower axial air permeabilities to be used as anti-marking coverings.

Other objects, features, and advantages of the present invention will be explained in the detailed description of the invention below, having reference to the following drawings:

DETAILED DESCRIPTION OF THE INVENTION

Figure 1:
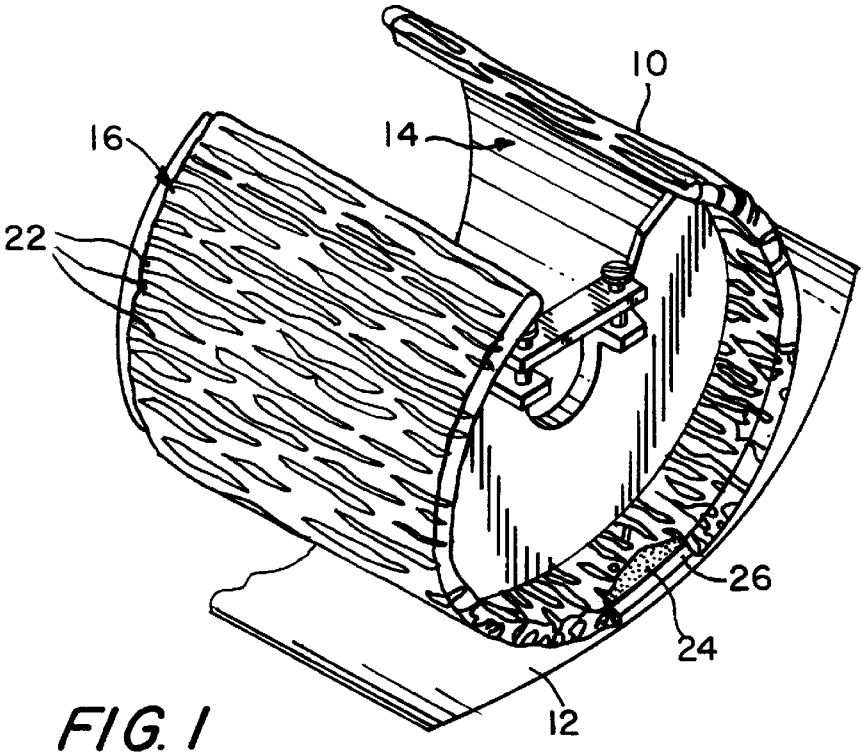
FIG. 1 (PRIOR ART)
FIG. 1 is a diagram illustrating a ridged fabric of the prior art applied on a press roll as an anti-marking material.

Referring to FIG. 1, a typical prior art anti-marking system employs a transfer cylinder assembly 10 for conveying printed sheets 12 from one printing press station to another. The assembly 10 includes a conventional transfer cylinder 14 (or other equivalent structure) wrapped in a netting material 16 which has ridges 22 serving to engage the printed sheets 12 by contact while cushioning and yielding as each printed sheet bears against the ridges 22. The material 16 is secured with fasteners 24 within the end rims 26 of the cylinder in a conventional manner.

Figure 2:
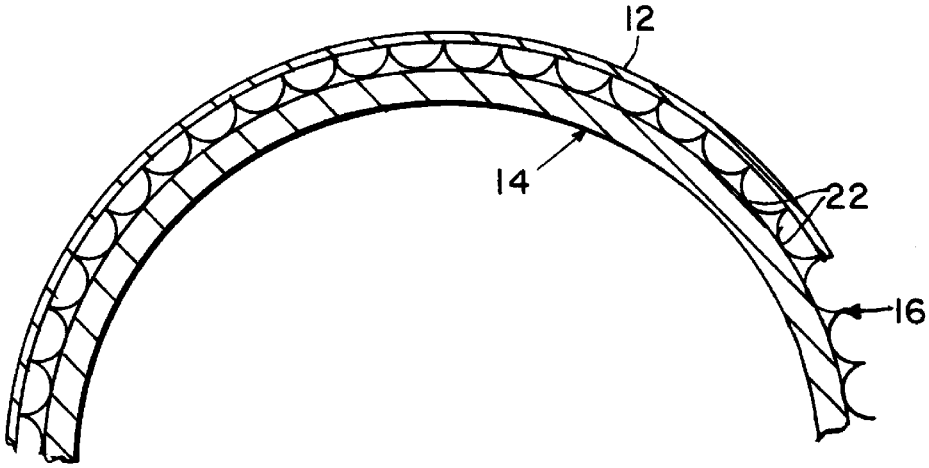
FIG. 2 (PRIOR ART)
FIG. 2 is a diagram showing the ridges of the prior art fabric making contact with the printed sheet.

As shown in FIG. 2, the ridges 22 of the prior art anti-marking material 16 are spaced fairly widely apart and project upwardly toward the printed sheets 12 for the purpose of cushioning their contact with the material. However, the present invention seeks to avoid such contact between the printed sheets and the covering on the press cylinder by employing a covering that has a surface structure which will allow an air layer to be maintained under the printed sheets. The invention concept is similar in the way that a hovercraft can skim over a surface having relatively small surface irregularities, whereas its operation is made difficult by contact with large features in rough terrain.

In accordance with the present invention, contact of the printed sheets with the cylinder is eliminated by using an anti-marking covering having a high axial air permeability to maintain an air layer under the printed sheets and a substantially uniform surface structure free of raised areas that might protrude through the air layer and make contact with the printed sheets. In this application, the term "axial air permeability" is used to refer to air permeability through the covering material parallel to its surface. The term "uniform surface structure" refers to a three-dimensional structure of the covering which is flat, has no discernible ridges or features, or has surface features which are closely spaced enough so as to present a substantially even surface from the standpoint of sheet transport. The more uniform is the surface of the covering, the lower the axial air permeability and the smaller the air layer that needs to exist to avoid contact with the printed sheets.

Figure 3:
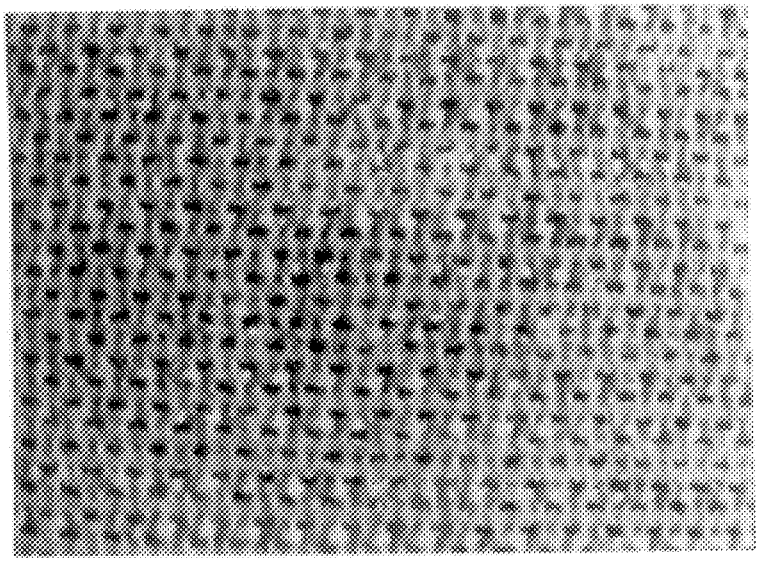
FIG. 3 is a photograph at 2× magnification showing a preferred embodiment of a microcreped fabric for use as an anti-marking covering in accordance with the present invention.

Referring to FIG. 3, a preferred fabric for use as an anti-marking covering in the present invention is shown having a three-dimensional structure of distributed openings throughout its surface and compressive microcreping extending in the machine direction (the vertical direction in the figure). The base fabric is 100% rayon nonwoven formed by hydroentanglement on a support screen of 16×14 mesh for forming the open areas throughout the fabric. The fabric is subjected to comb-roll MICREX™ compressive microcreping which produces creped areas which are closely spaced about 0.062 (1/16) inch apart.

Figure 4:
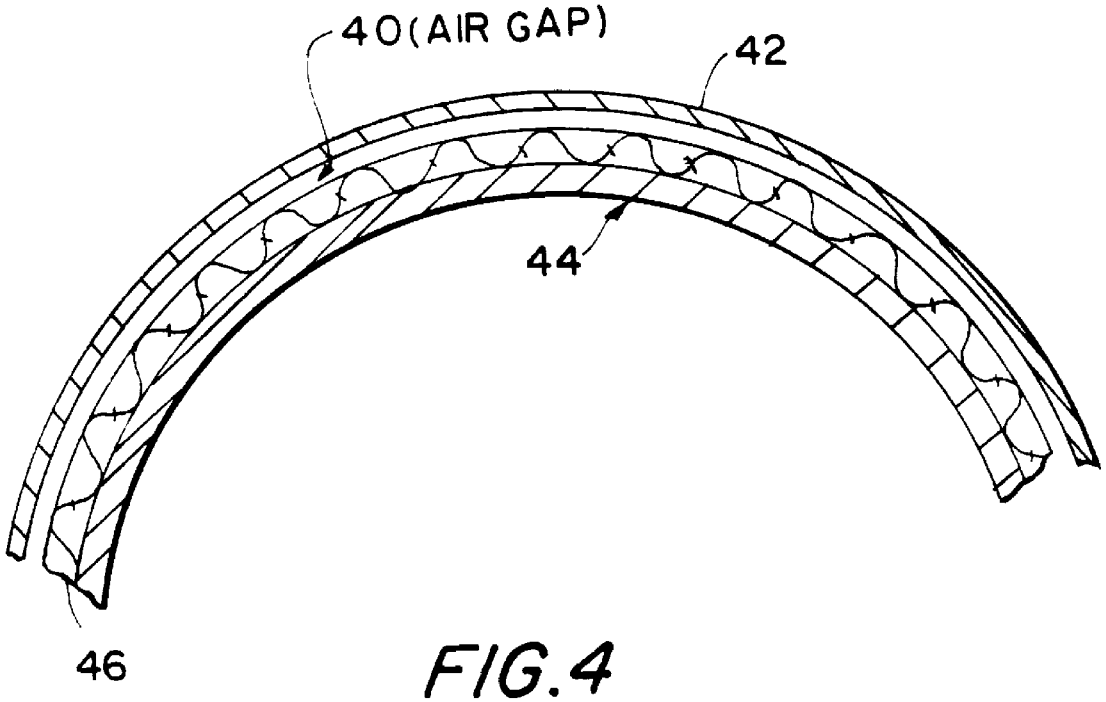
FIG. 4 is a diagram showing an air gap created between the anti-marking covering of the present invention and sheets conveyed on the press roll.

As illustrated in FIG. 4, when the anti-marking fabric 46 is secured on a transfer roll 44, it allows an air layer 40 to be maintained under the printed sheets 42 so that contact is avoided and no ink is transferred to the sheets. The preferred microcreped nonwoven fabric has a thickness of about 0.041 inch. Thickness is measured using an Ames gauge with a foot diameter of 1.5 inches and a load of 0.08 psi. The distributed open areas and microcreping provide an axial air permeability of 0.279 cfm parallel to the surface of the transfer roll which allows an air gap to be maintained under the sheets. The close spacing of the microcreped areas presents a substantially uniform surface (from the standpoint of sheet transport) so that there are no high points that might protrude through the air gap and contact the sheet.

The operation of the anti-marking covering on the press cylinder will now be described. As a freshly printed sheet 42 approaches the press cylinder, the leading edge of the sheet is held in grippers that cause the sheet to move along with the rotating cylinder. The movement of the sheet with the cylinder in the machine direction creates a relative movement between the sheet and air above the sheet, while the air under the sheet is relatively stagnant. This difference in air velocity above and beneath the sheet causes a reduction in air pressure above the sheet relative to the air pressure under the sheet. This has a tendency to lift the sheet away from the cylinder. Centrifugal force caused by the rotation of the cylinder also has a tendency to lift the sheet away from the cylinder. The combination of these two forces tends to cause the sheet to lift away from the cylinder. If air is prevented from access under the sheet, then the tendency of the center of the sheet to lift up creates a partial vacuum under the sheet. Depending upon the dynamics occurring at the time, this would in turn cause the edges or other parts of the sheet to pull down in contact with the cylinder and to transfer ink from the sheet to the cylinder and vice versa.

The anti-marking material of the present invention has a three-dimensional surface structure which provides a high level of axial air permeability over and through the material in the surface direction such that an air flow can occur through the anti-marking material under the printed sheets when the cylinder rotates. The air flow under the sheets allows air to move to the areas where there is a pressure reduction due to the moving air above the sheets. The airflow prevents a partial vacuum from being formed under the sheets that would pull parts of the sheet down in contact with the cylinder.

In contrast to the DeMoore prior art system, the present invention does not require relative movement between the anti-marking covering and the outer surface of the cylinder. The cylinder surface does not require any special surface treatment or coating for a low coefficient of friction. Furthermore, the present invention does not rely upon fabric deflection or fabric cushioning, as in the Ward prior art system, to soften the impact of physical contact with the printed sheets.

Figure 5:
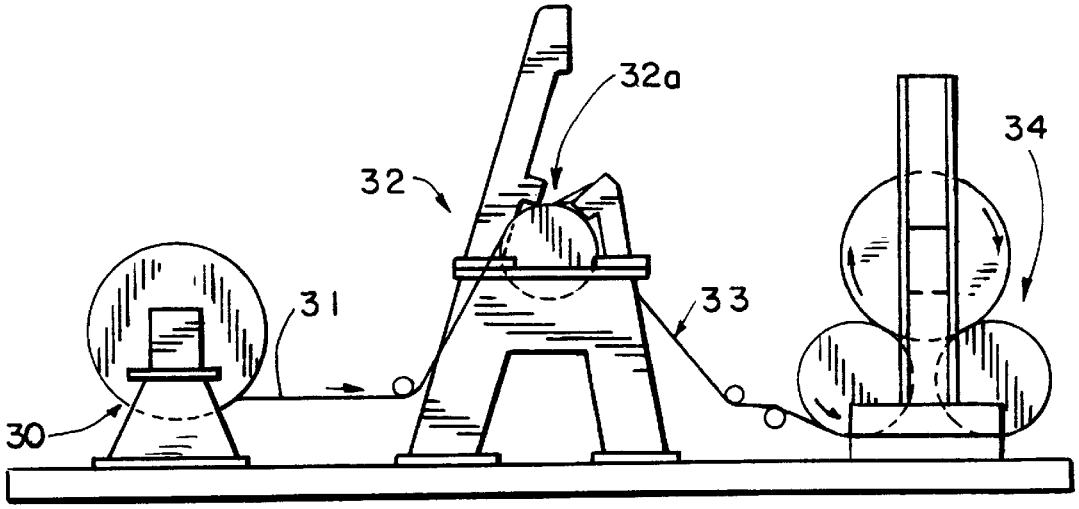
FIG. 5 is a diagram illustrating a line for comb-roll microcreped compressive forming of the preferred fabric in FIG. 3.
Figure 6:
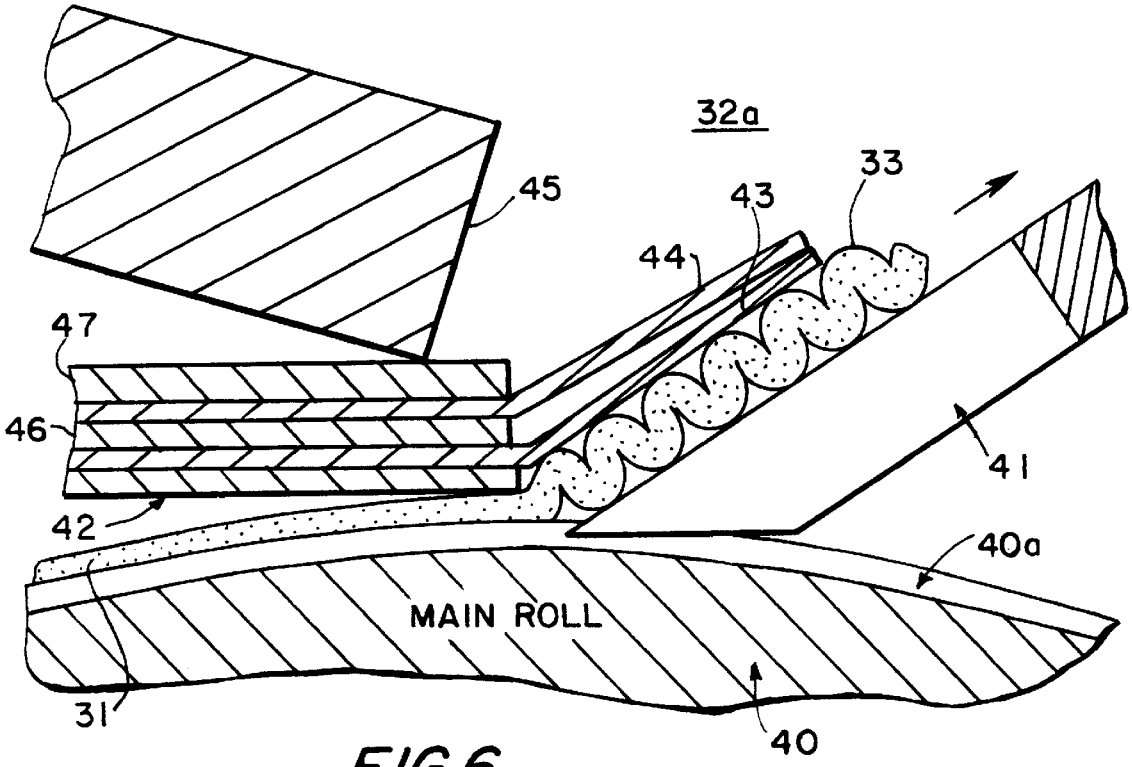
FIG. 6 is a diagram showing details of the compressive forming zone in the fabrication line of FIG. 5.

FIGS. 5–6 show a fabrication line and detail for forming the preferred microcreped anti-marking material. A stock material of 100% rayon hydroentangled nonwoven, having a caliper of 19 mils and a basis weight of 38.7 gm/yard$^2$, is subjected to comb-roll MICREX™ compressive forming. The MICREX™ process essentially employs a heated comb-roll in a compressive microcreping process to permanently alter the structure of the stock fabric into alternating areas of bulked and compressed portions. Equipment for the MICREX™ compressive forming process is commercially available from Micrex Corporation, of Walpole, Mass.

As shown in FIG. 5, the MICREX™ compressive forming line includes an unwind stand 30 to supply the uncreped stock web 31, such as the 100% rayon hydroentangled nonwoven, microcreper 32 having a treatment cavity 32*a* for compressive forming of the microcreped material, and rewind stand 34 for winding up the microcreped web 33.

As shown in more detail in FIG. 6, the uncreped web 31 is conveyed into the treatment cavity 32*a* on a grooved surface 40*a* of a main roll 40 which is heated to about 225° F. A comb 41 having serrated teeth ends projecting into the grooves of the main roll pushes the incoming web against a step 42, primary blade 46/47, and flexible blade 43/44. As the next increment of incoming web forces its way toward the comb, the material becomes folded over and pressed together in a bulked portion. The flexible blade 43/44 is resiliently biased toward the comb 41 by pressure applied by a head plate 45 on the primary blade 46/47, such that the advance of the web through the station is retarded and the web becomes compressed in a series of alternating bulked and compressed portions.

Microcreping of the preferred fabric is performed at a roll temperature of 225° F. with a blade package and pressure that yields approximately 25% compaction. Line speed on the unwind of stock material is 60 fpm while line speed on the rewind is 43 fpm. The blade setup uses a 0.010 inch step, 0.020/0.020 inch thick primary blade, and 0.006/0.008 inch flexible blade. The head pressure is 40 psi. The microcreped material has a resulting thickness of 0.041 inch and a basis weight of 70.0 gm/yd$^2$.

For printing use, the microcreped material is stretched and wrapped tightly around a printing press cylinder. The bulked portions of the material open up and form areas for air flow in the surface direction of the material. The compressed portions, being densified by heating during the compressive forming process, have load bearing characteristics and elasticity which enable the fabric to be applied tightly and conform to the roll. The fabric is wrapped around the cylinder with a tension in the range of about 10 gm/inch and does not move during use. With this amount of tension, all wrinkles and surface unevenness are pulled out, and the fabric stretches to a consistent thickness which does not change substantially with further increase in tension.

Figure 7:
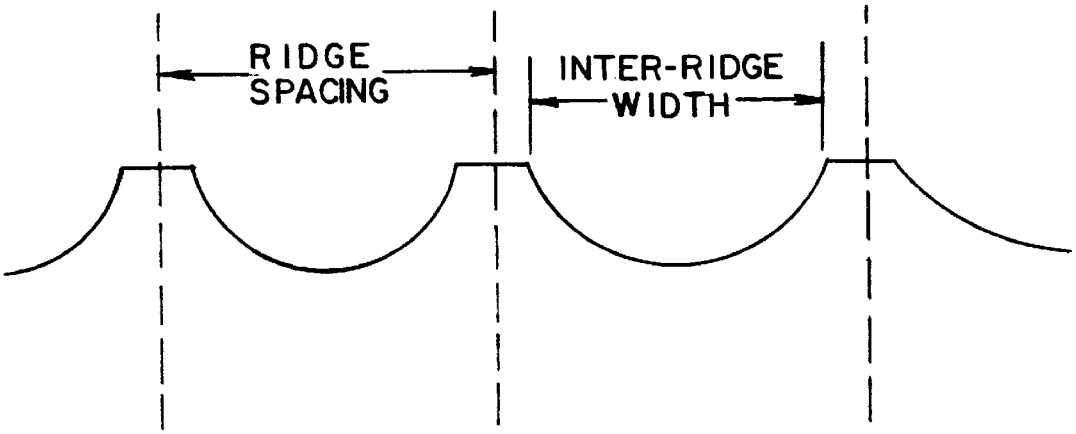
FIG. 7 illustrates measurement of the ridge spacing and inter-ridge width of the preferred fabric in FIG. 3.

When applied on a press cylinder, the preferred material has a ridge spacing of the microcreped areas of about 0.062 inch and an inter-ridge width of about 0.040 inch. The measurement of these spacings is illustrated in FIG. 7. The ridge spacing is taken as the pitch between the centers of the ridges, whereas the inter-ridge width is taken as the recessed or open width between the ridges.

The prior art SUPER BLUE™ fabric and the ridged material disclosed in the Ward patent were measured as having ridge spacings ranging from 0.25 to 0.50 inch and inter-ridge widths ranging from 0.125 to 0.438 inch. These wide spacings between ridges of the prior art fabrics apparently cause the ridges to protrude through any air layer that may occur under the sheets and make contact with the printed sheets (as intended). In contrast, the preferred material of the present invention has much smaller ridge spacings/widths so as to present a substantially uniform surface (from the standpoint of sheet transport) free of protruding areas. While the lower ranges of ridge spacings/widths of the prior art fabrics approach that of the preferred material, the higher ranges of wide spacings between ridges of the prior art fabrics are believed to be responsible for the protruding effect of the ridges which negates any air layer created under the sheets so that the sheets make contact with the ridges.

Figure 8:
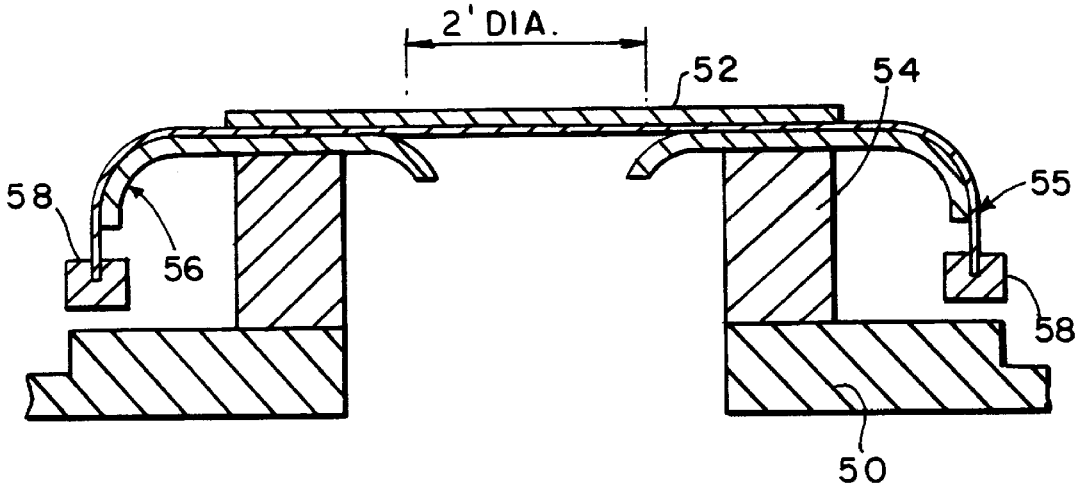
FIG. 8 is a diagram of a modified air permeability tester for measuring axial air permeability (parallel to the surface) of the anti-marking material.
Figure 9A:
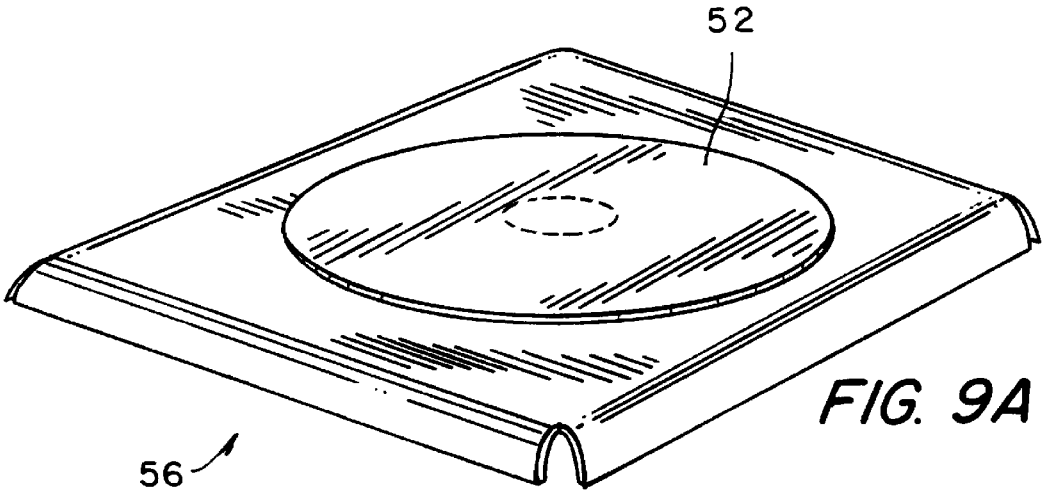
FIGS. 9A and 9B show details of components of the modified air permeability tester.
Figure 9B:
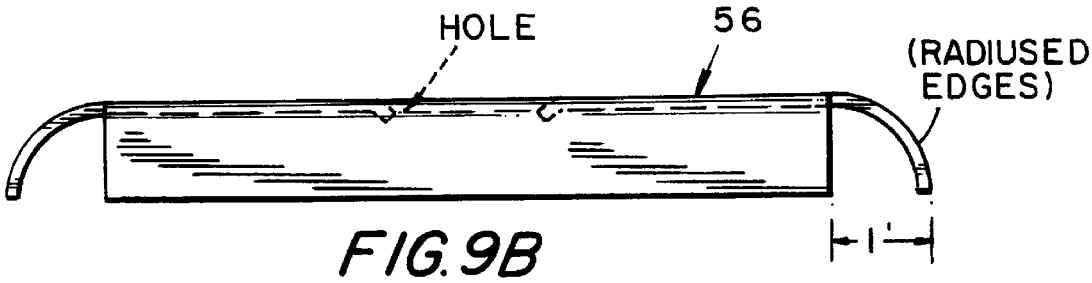

The surface air permeability of the anti-marking material of the present invention can be quantified using a standard Frazier air permeability tester with a modified support for testing a fabric sample under tension. Referring to FIG. 8, the end of an air port 50 for a standard Frazier tester is fitted with a cylindrical transition piece 54 with a center hole diameter of 3.0 inches and an outside diameter of 6.0 inches. A flat metal support plate 56 is mounted on the transition piece 54. The support plate 56 is rectangular in shape with a radiused center hole of about 1.94 inch inner diameter (2.0 inch radiused diameter), and radiused outer edges. Details of the support plate 56 are shown in FIGS. 9A and 9B. A material sample SS is stretched over the center hole of the support plate 56 and held down by a flat plastic disc 52 of 14-inch diameter and 0.20-inch thickness placed on top of it. Weighted strips 58 are attached to the ends of the material sample SS to apply a specified tension of 20 gm/inch to it. The radiused outer edges of the support plate 56 allows the material sample to slide over the smooth surface under tension. The weights 58 are attached on all sides so that a uniform tension is applied across the sample. The tester accommodates a test sample size of approximately 20 inches square. The Frazier air permeability tester is set up for ASTM Test D737, with a pressure differential of 0.5 inch water gauge. Operation of the tester measures the air permeability through the sample parallel to the surface of the sample.

Using the modified air permeability tester, the microcreped nonwoven fabric described above was measured to have an air permeability of 0.279 cfm. In contrast, a sample of the fabric disclosed in the DeMoore patent (40 count gauze) has a measured surface air permeability of only 0.095 cfm. The higher level of surface air permeability obtained with the microcreped material was found to provide the ideal air flow characteristics for creating an air layer under the sheets and avoiding contact of the printed sheets with the cylinder. Any contact that does takes place occurs so infrequently that any ink transferred to the anti-marking material dries before the same area of the anti-marking material contacts a printed sheet again. While the prior art SUPER BLUE™ fabric and the ridged material disclosed in the Ward patent have comparable surface air permeabilities as the preferred fabric, their wide spacings of up to 0.50 inch between ridges cause the ridges to protrude through any air layer that may occur under the sheets and make contact with the printed sheets.

Other fabrics having high axial air permeability and/or a substantially uniform surface structure were tested for suitability for use as an anti-marking material in accordance with the present invention. A summary of the fabrics tested is provided in the following Table I, including comparison to the SUPER BLUE™ and Ward prior art fabrics. The Denmoss knit cotton having a thickness of 32 mils and a spacing between knit lands of 0.125 inch and inter-land width of 0.062 inch was measured to have a surface air permeability of 0.755 cfm and was successful in printing use. A similar United Textile knit cotton had a surface air permeability of 0.732 cfm and was successful. A Claridge knit with a flat surface structure had the highest-measured surface air permeability of 0.887 cfm and was successful. Another version of the microcreped hydroentangled nonwoven (HEF 1054.1) was also found to be successful, while a flat version of the MICREX nonwoven having a lowest-measured surface air permeability of 0.138 cfm could be used but had one failure out of 12 trials. As an option, the fabrics were treated with SCOTCHGUARD™ soil-resistant treatment.

Figure 10:
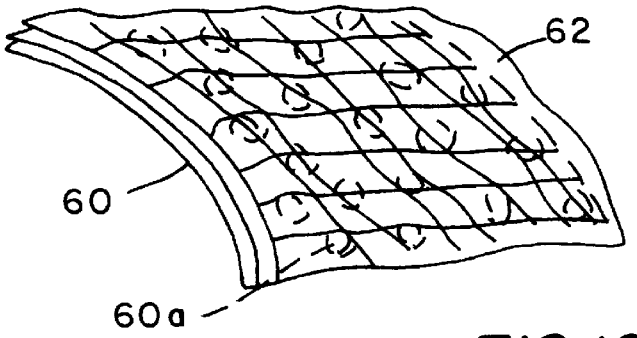
FIG. 10 is a diagram of another embodiment of an anti-marking covering of the present invention.

Referring to FIG. 10, another version of the invention is shown schematically employing a press cylinder 60 having a surface perforated with holes 60*a* and an anti-marking covering 62 with an open structure and a uniform surface free of raised areas. The open-structured covering may be a woven or knitted fabric or an open-celled foam, or any of a variety of perforated sheet materials. The perforated cylinder acts to supply air through the holes to the covering, and the structure of the covering distributes the air through the covering to allow the air layer to be maintained under the sheets. The supply of air through the cylinder holes permits a wide variety of open-structured materials having lower air permeabilities to be used as anti-marking coverings.

In summary, the anti-marking material of the present invention provides the following advantages over the prior art:

1. Transfer of ink between the sheets and the press cylinder is avoided. The covering does not have to be replaced or adjusted frequently.

2. The press cylinder does not have to be treated with any special low-friction surface treatment.

3. The covering material is attached tightly to the press cylinder, so that no special skill is required to obtain a certain amount of looseness or puckering of the material as provided in the prior art. Flopping of loosely wrapped anti-marking material is avoided.

Other modifications and variations may be devised based upon the above-described principles of the invention. It is intended that all such modifications and variations be included within the scope of the invention as defined in the following claims.

TABLE I

| | SAMPLE | AIR PERMEABILITY (cfm) | WEIGHT (g/yd2) | INTER-RIDGE width (in) | RIDGE SPACING (in) | THICKNESS (in) |
|---|---|---|---|---|---|---|
| 1 | SUPERBLUE | 0.305 | 66.0 | 0.125–0.438 | 0.25–0.5 | 0.053 |
| 2 | WARD MATERIAL | 0.288 | 66.2 | 0.125–0.438 | 0.25–0.5 | 0.040 |
| 3 | THICK COTTON KNIT | 0.533 | 248.0 | 0.062 | 0.125 | 0.049 |
| 4 | RED OPEN STRUCTURE CROCHET | 0.930 | 93.50 | 0.312 | 0.375 | 0.028 |
| 5 | DENMOSS KNIT COTTON 1575 | 0.755 | 128.7 | 0.082 | 0.125 | 0.032 |
| 6 | HEF 1054.1 | 0.372 | 61.2 | 0.040 | 0.062 | 0.020 |
| 7 | UNITED TEXTILE KNIT COTTON 8100 | 0.732 | 129.6 | 0.062 | 0.125 | 0.033 |
| 8 | BD96-24 (B) | 0.279 | 70.0 | 0.040 | 0.062 | 0.041 |
| 9 | CHEESECLOTH GR 40 | 0.095 | 20.6 | FLAT | FLAT | 0.013 |
| 10 | CLARIDGE KNIT 8821 | 0.887 | 168.9 | FLAT | FLAT | 0.036 |
| 11 | BD96-24 (A) | 0.138 | 40.4 | FLAT | FLAT | 0.029 |

| | SAMPLE | DESCRIPTION | SUCCESS/FAILURE (printing press) |
|---|---|---|---|
| 1 | SUPERBLUE | OPEN WEAVE CORRUGATED GAUZE | NOT TESTED |
| 2 | WARD MATERIAL | OPEN WEAVE CORRUGATED GAUZE | NOT TESTED |
| 3 | THICK COTTON KNIT | NOVELTY KNITTED STRUCTURE | FAILED (too thick) |
| 4 | RED OPEN STRUCTURE CROCHET | PROMINENT HARD NUBLIKE PROTRUSIONS AND DIAMOND SHAPED STRUCTURE | FAILED (collected ink) |
| 5 | DENMOSS KNIT COTTON 1575 | THINNER VERSION OF #3 | SUCCESS |
| 6 | HEF 1054.1 | MICREXED NONWOVEN | SUCCESS |
| 7 | UNITED TEXTILE KNIT COTTON 8100 | THINNER VERSION OF #3 | SUCCESS |
| 8 | BD96-24 (B) | MICREXED NONWOVEN | SUCCESS |
| 9 | CHEESECLOTH GR 40 | SIMILAR TO DEMOORE PATENT | NOT TESTED |
| 10 | CLARIDGE KNIT 8821 | THINNER VERSION OF #3 | SUCCESS |
| 11 | BD96-24 (A) | FLATTER VERSION OF #8 | MARGINAL SUCCESS* *ONE FAILURE OUT OF TWELVE TRIALS |

The Invention claimed is:

1. A method of using an anti-marking covering for preventing ink marking of freshly printed sheets conveyed on a printing press transfer cylinder, comprising the steps of:

(a) applying a covering to the transfer cylinder, said covering having a structure including a thickness with an inner surface facing the transfer cylinder and an outer surface facing outwardly toward the sheets to be conveyed and further having an axial air permeability through the covering in a surface direction parallel to its outer surface sufficient to allow an air layer to be maintained between the printed sheets and the outer surface of the covering when the transfer cylinder is rotated, said outer surface of said covering being a substantially uniform surface free of raised areas that might protrude through the air layer and make contact with the printed sheets; and (b) conveying the printed sheets by rotating the transfer cylinder having the covering applied thereon so as to allow the air layer to be maintained under the printed sheets due to the axial air permeability and substantially uniform outer surface of the covering, whereby contact between the printed sheets and the cylinder is avoided, said covering being a layer of open-celled foam covering the transfer cylinder.

2. A method for preventing ink marking of freshly printed sheets according to claim 1, wherein said transfer cylinder has a surface perforated with holes, and said open-celled foam covering is supplied with air from said transfer cylinder holes.

3. A method for preventing ink marking of freshly printed sheets conveyed on a printing press transfer cylinder, comprising the steps of:

(a) applying a covering to the transfer cylinder, said covering having a structure including a thickness with an inner surface facing the transfer cylinder and an outer surface facing outwardly toward the sheets to be conveyed, and further having an axial air permeability through the covering parallel to its outer surface sufficient to allow an air layer to be maintained between the printed sheets and the covering when the transfer cylinder is rotated, said outer surface of said covering being a substantially uniform surface free of raised areas that might protrude through the air layer and make contact with the printed sheets; and (b) conveying the printed sheets by rotating the transfer cylinder having the covering applied thereon so as to allow the air layer to be maintained under the printed sheets due to the axial air permeability and substantially uniform outer surface of the covering, whereby contact between the printed sheets and the cylinder is avoided, wherein said covering is 100% rayon hydroentangled nonwoven fabric subjected to comb-roll microcreping for compressive forming of microcreped areas in the outer surface of the fabric.

4. A method for preventing ink marking of freshly printed sheets according to claim 3, wherein the microcreped areas in the outer surface of said fabric are closely spaced about 1/16 inch apart.

5. A method for preventing ink marking of freshly printed sheets according to claim 3, wherein the outer surface of said microcreped nonwoven fabric has an axial air permeability of about 0.279 cfm.

6. A method for preventing ink marking of freshly printed sheets according to claim 3, wherein the outer surface of said fabric has an axial air permeability not lower than about 0.138 cfm.

7. A method for preventing ink marking of freshly printed sheets according to claim 3, wherein said outer surface of said fabric is comprised of closely spaced features having a spacing of not more than about 0.125 inch.

8. A method for preventing ink marking of freshly printed sheets according to claim 3, wherein said fabric has a tensile strength that allows it to be tightly wrapped onto the transfer cylinder so that it does not move relative to the cylinder surface during use.

9. A method of using an anti-marking covering for preventing ink marking of freshly printed sheets conveyed on a printing press transfer cylinder, comprising the steps of:

(a) applying a covering to the transfer cylinder, said covering being a fabric having an open, three-dimensional structure including a thickness with an inner surface facing the transfer cylinder and an outer surface facing outwardly toward the sheets to be conveyed and further having an axial air permeability through its structure in a surface direction parallel to its outer surface sufficient to allow an air layer to be maintained between the printed sheets and the outer surface of the fabric when the transfer cylinder is rotated, said outer surface of said fabric being a substantially uniform surface free of raised areas that might protrude through the air layer and make contact with the printed sheets; and (b) conveying the printed sheets by rotating the transfer cylinder having the fabric applied thereon so as to allow the air layer to be maintained under the printed sheets due to the axial air permeability and substantially uniform outer surface of said fabric, whereby contact between the printed sheets and the cylinder is avoided.

10. A method of using an anti-marking covering according to claim 9, wherein said fabric is 100% rayon hydroentangled nonwoven fabric subjected to comb-roll microcreping for compressive forming of microcreped areas in the surface of the fabric.

11. A method of using an anti-marking covering according to claim 10, wherein the microcreped areas of said fabric are closely spaced about 1/16 inch apart.

12. A method of using an anti-marking covering according to claim 10, wherein said microcreped nonwoven fabric has an axial air permeability of about 0.279 cfm.

13. A method of using an anti-marking covering according to claim 9 selected from a group comprising woven fabric, knitted fabric, and nonwoven fabric.

14. A method of using an anti-marking covering according to claim 9 having an axial air permeability not lower than about 0.138 cfm.

15. A method of using an anti-marking covering according to claim 9 wherein said fabric has a surface structure comprised of closely spaced features having a spacing of not more than about 0.125 inch.

16. A method of using an anti-marking covering according to claim 9 comprised of a cotton knit fabric having an axial air permeability in the range of about 0.732 cfm to 0.887 cfm.

17. A method of using an anti-marking covering according to claim 9 having a tensile strength sufficient to allow it to be tightly wrapped onto the transfer cylinder so that it does not move relative to the cylinder surface during use.

* * * * *